US005669245A

United States Patent [19]

Shieh

[11] Patent Number: 5,669,245

[45] Date of Patent: Sep. 23, 1997

[54] YARN FEEDING DEVICE OF A CIRCULAR KNITTING MACHINE

[76] Inventor: Meei-Ju Shieh, 10-6F., No. 20, Lane 609, Sec. 5, Chung-Hsin Rd., Sanchung City, Taipei Hsein, Taiwan

[21] Appl. No.: 613,192

[22] Filed: Mar. 8, 1996

[51] Int. Cl.[6] ..... D04B 15/48

[52] U.S. Cl. ..... 66/132 T; 66/132 R; 242/47.01

[58] Field of Search ..... 66/132 T, 132 R, 66/125 R; 242/47.01

[56] References Cited

U.S. PATENT DOCUMENTS

| | | | |
|---|---|---|---|
| 4,386,508 | 6/1983 | Jacobsson | 66/132 T |
| 4,457,144 | 7/1984 | Sawazaki | 66/132 T |
| 4,574,353 | 3/1986 | Hellström et al. | 66/132 T X |
| 4,574,847 | 3/1986 | Matsumoto | 242/47.01 X |
| 4,598,560 | 7/1986 | Sawazaki | 66/132 T |
| 4,691,873 | 9/1987 | Gutschmit | 242/47.01 |
| 4,754,936 | 7/1988 | Dalmau Güell et al. | 242/47.01 |
| 4,799,517 | 1/1989 | Bucher | 242/47.01 X |
| 4,918,948 | 4/1990 | Nürk | 242/47.01 X |
| 5,261,586 | 11/1993 | Chen | 66/132 T X |
| 5,388,747 | 2/1995 | Chen | 66/132 R X |

FOREIGN PATENT DOCUMENTS

| | | | |
|---|---|---|---|
| 3437252 | 1/1986 | Germany | 242/47.01 |
| 1192108 | 5/1970 | United Kingdom | 242/47.01 |

*Primary Examiner*—John J. Calvert
*Attorney, Agent, or Firm*—Varndell Legal Group

[57] ABSTRACT

A yarn feeding device includes a mounting frame fastened to the frame structure of a circular knitting machine to hold a yarn guide plate, a driving wheel, a yarn guide bracket, a plurality of plastic yarn tension guides, and a plurality of yarn feeding wheels. Each yarn tension guide has a rotating tension adjustment plate stopped at the respective yarn tension guide rod and turned to adjust the oscillating amplitude of the respective yarn tension guide rod so that the degree of circumferential engagement of the respective yarn with the wheel surface of the respective yarn feeding wheel is relatively adjusted. The plastic yarn feeding wheels have a respective metal wheel hub respectively connected together to protect the respective yarn feeding wheel against compression force; each yarn tension guide has a yarn tension guide rod secured in place by a spring element, and an adjustment screw connected to the spring element by a spring holder and turned to adjust the tension of the spring element and the yarn tension guide rod.

2 Claims, 14 Drawing Sheets

YARN FEEDING DEVICE OF A CIRCULAR KNITTING MACHINE

BACKGROUND AND SUMMARY OF THE INVENTION

The present invention relates to a yarn feeding device for circular knitting machines, and relates more particularly to such a yarn feeding device which protect the yarn feeding wheels against deformation and, which can be conveniently adjusted to change the tension of the yarn tension guides.

FIGS. 1, 2, 3, and 4 show a yarn feeding device according to U.S. Pat. No. 4,598,560. This structure of yarn feeding device is somewhat functional, however it has drawbacks as outlined hereinafter: (1) Although the movable yarn guides can be moved relative to each other to adjust the degree of circumferential engagement of the yarns with the surfaces of the yarn feeding wheel. However, this complicated adjusting structure is difficult to install, and greatly increases the cost of the yarn feeding device. (2) Because each yarn feeding wheel is divided into two frictional yarn driving surfaces for the engagement of the individual rungs of the yarn, the yarns tend to be tangled with fluffed cotton to further affect the quality of the fabric. (3) Two aluminum rims must be used when knitting a four-color fabric, or three aluminum rims must be used when knitting a six-color fabric; the installation of additional aluminum rims relatively increases the cost of the yarn feeding device, furthermore the installation procedure of the additional aluminum rims is complicated. (4) This structure of yarn feeding device has no convenient yarn tension adjusting means for adjusting the tension of the yarn.

FIGS. 5, 6 and 7 show another structure of yarn feeding device according to the prior art. However, this structure of yarn feeding device still has drawbacks as follows: (1) The movable adjustment plate can be adjusted to vary the degree of circumferential engagement of the yarns with the yarn feeding wheels, however the degree of circumferential engagement of the yarn with the respective individual yarn feeding wheel can not be separately adjusted. (2) A space is left at the front end of each yarn tension guide holder in which fluffed cotton and dust tend to be gathered. (3) This structure of yarn feeding device does not have yarn tension adjusting means for adjusting the tension of the yarn. (4) The yarn feeding wheel is integrally made from plastic, and divided into a plurality of wheel sections for feeding respective yarns, however the lowest wheel section will be forced to deform when the yarn feeding wheel is fixedly secured to the frame by screws. (5) Because the yarn feeding wheel is divided into a plurality of wheel sections and each wheel section is divided into two frictional yarn driving surfaces, a plurality of rubber collars must be provided and installed corresponding to the number of the frictional yarn driving surfaces, however it is not easy to install the rubber collar more particularly at the middle section. (6) When to make a different specification of fabric with different number of different color yarns, a different yarn feeding wheel must be used.

The present invention has been accomplished to provide a yarn feeding device which eliminates the aforesaid drawbacks. According to one aspect of the present invention, the yarn feeding device includes a mounting frame fastened to the frame structure of a circular knitting machine to hold a yarn guide plate, a driving wheel, a yarn guide bracket, a plurality of plastic yarn tension guides, and a plurality of yarn feeding wheels respectively covered with a respective collar, wherein each yarn tension guide has a rotating tension adjustment plate stopped at the respective yarn tension guide rod and turned to adjust the oscillating amplitude of the respective yarn tension guide rod so that the degree of circumferential engagement of the respective yarn with the wheel surface of the respective yarn feeding wheel is relatively adjusted. According to another aspect of the present invention, each plastic yarn feeding wheel has an annular flange around the wheel face so that an annular convex portion is formed around the periphery of the respective rubber collar to separate two runs of the respective yarn after the installation of the respective rubber collar. According to still another aspect of the present invention, the plastic yarn feeding wheels have a respective metal wheel hub respectively connected together to protect the respective yarn feeding wheel against compression force. According to still another aspect of the present invention, each yarn tension guide has a yarn tension guide rod secured in place by a spring element, and an adjustment screw connected to the spring element by a spring holder and turned to adjust the tension of the spring element and the yarn tension guide rod. According to a yet further aspect of the present invention, the yarn tension guides are respectively disposed at an inner side adjacent to the left row of thread eyes of the yarn guide bracket so that sufficient space is provided for threading the yarns.

DETAILED DESCRIPTION OF THE PREFERRED EMBODIMENT

Figure 1:
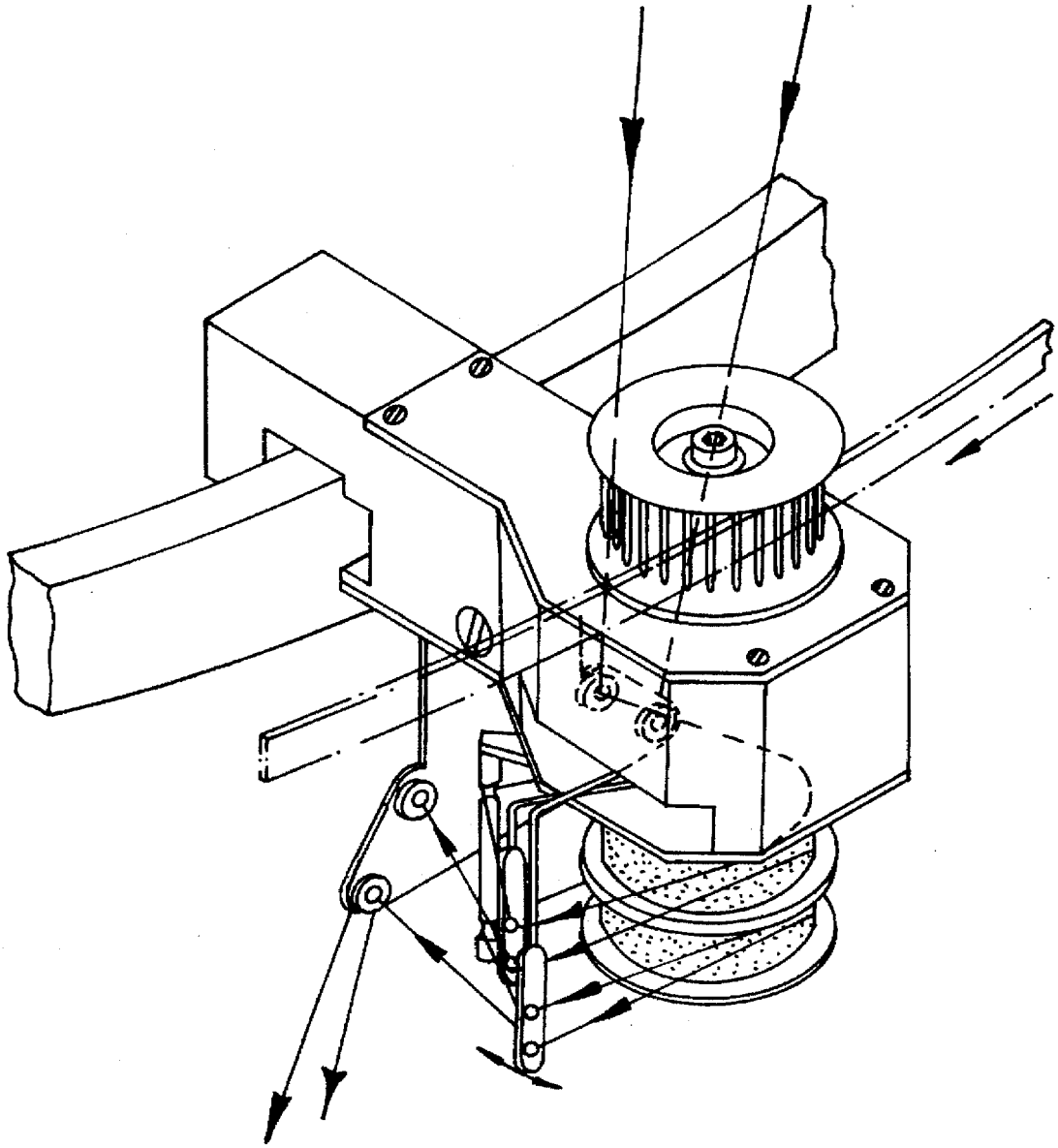
Fig.1 PRIOR ART
FIG. 1 is a perspective view of a yarn feeding device according to U.S. Pat. No. 4,598,560.
Figure 2:
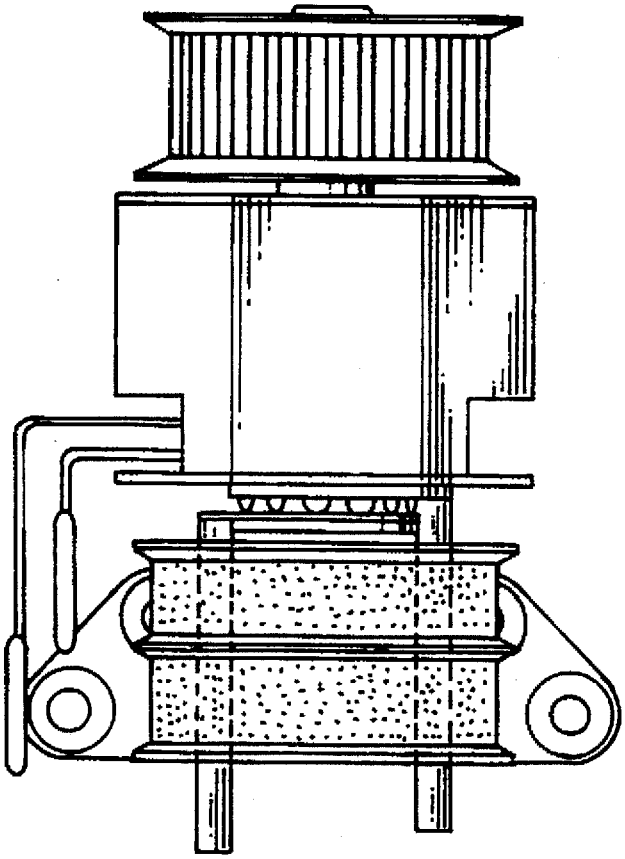
Fig.2 PRIOR ART
FIG. 2 is a side view of the yarn feeding device shown in FIG. 1.
Figure 3:
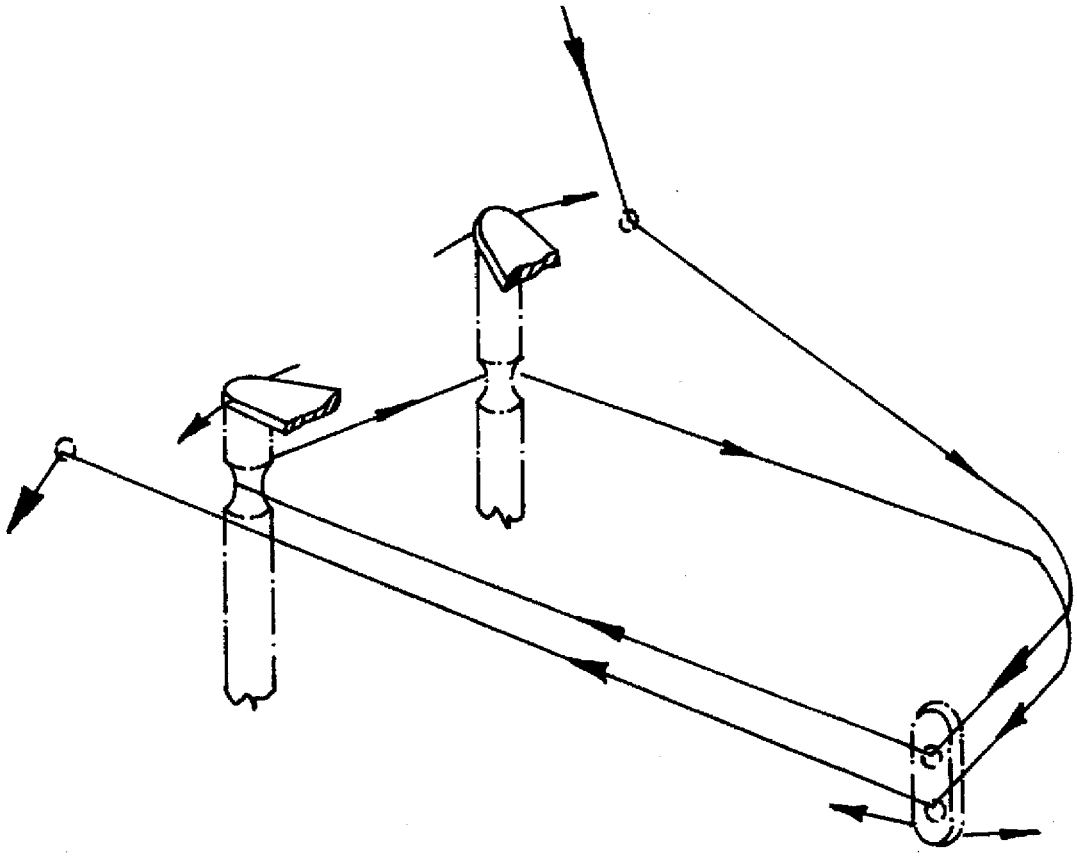
Fig. 3 PRIOR ART
FIG. 3 is a partial view in an enlarged scale of FIG. 1, showing the adjustment of the degree of circumferential engagement of the yarn with the wheel face.
Figure 4:
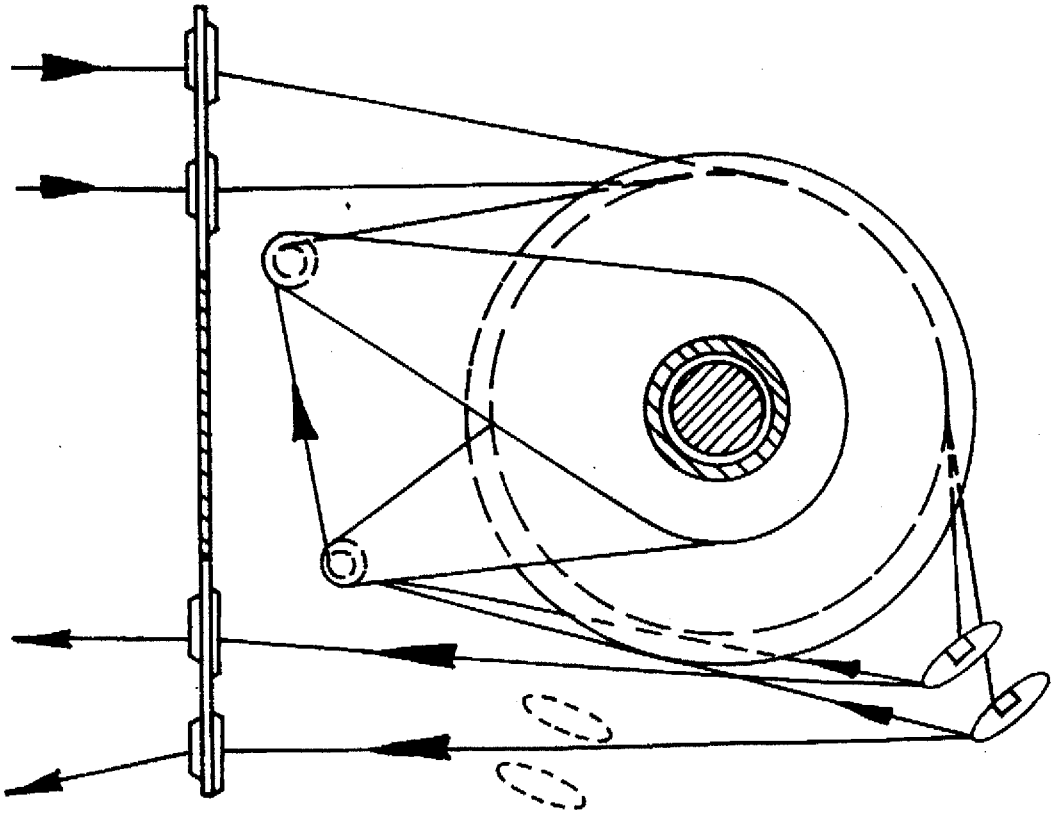
Fig. 4 PRIOR ART
FIG. 4 is a top view of the yarn feeding device shown in FIG. 1.
Figure 5:
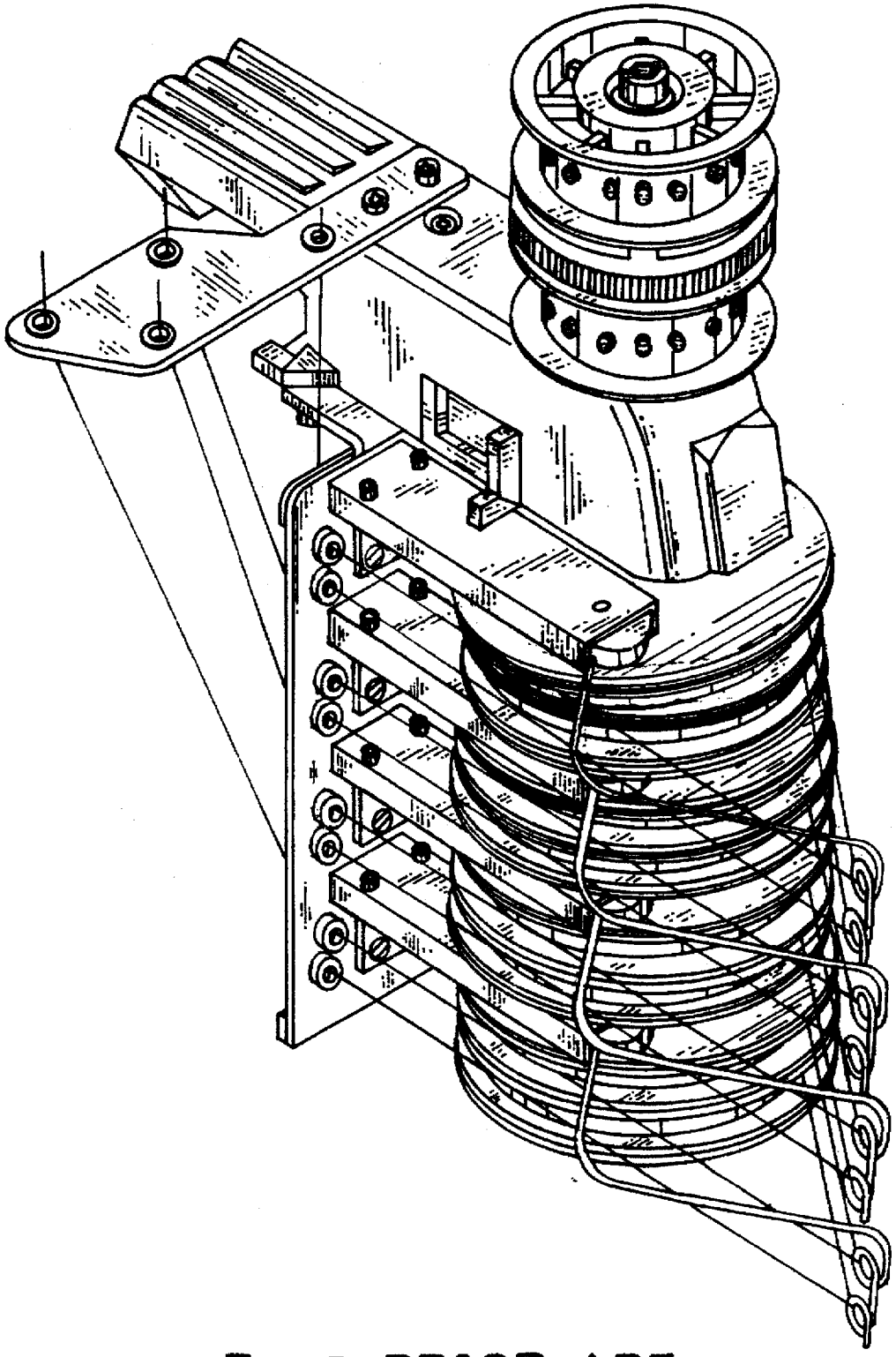
Fig.5 PRIOR ART
FIG. 5 is an elevational view of another structure of yarn feeding device according to the prior art.
Figure 6:
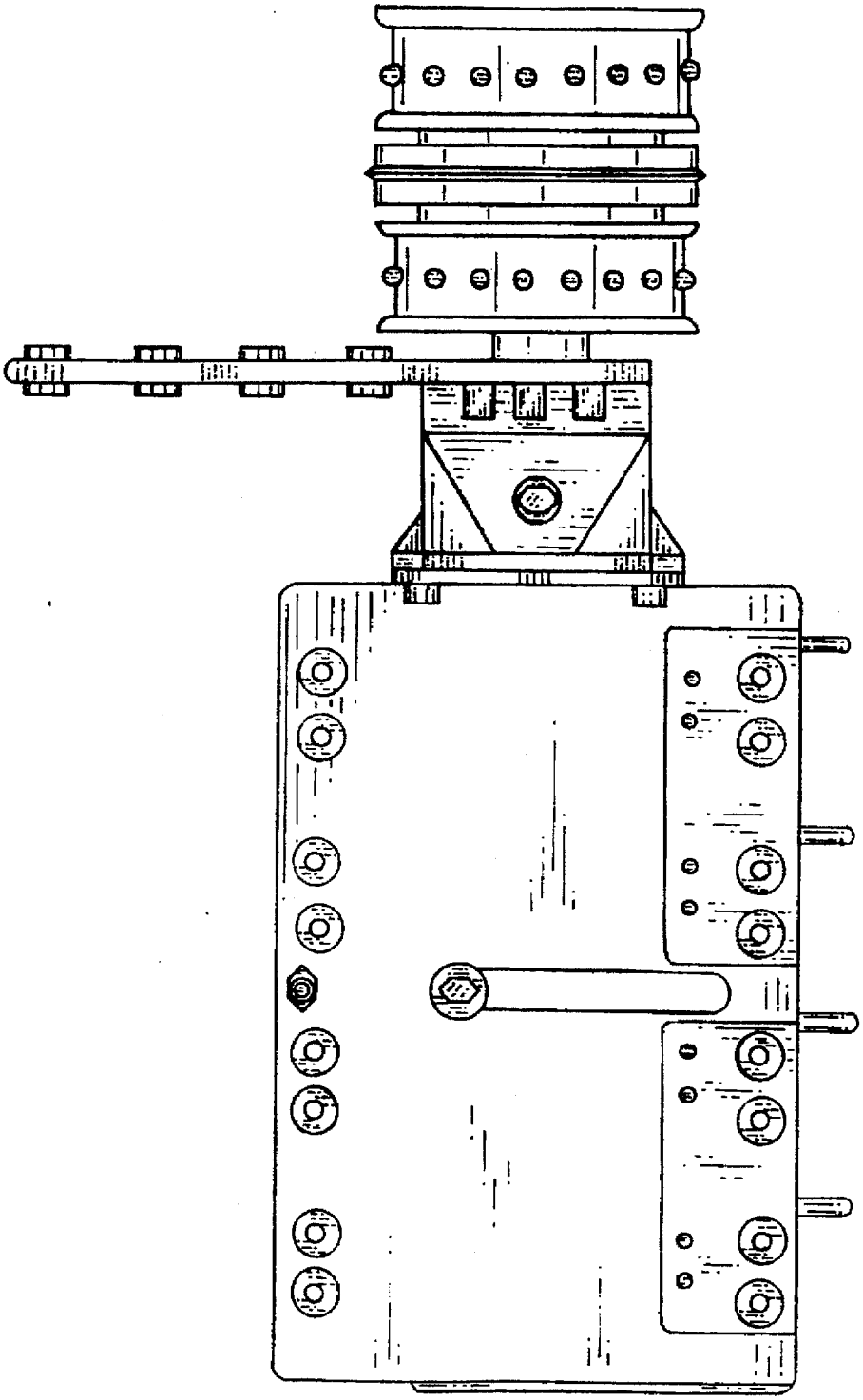
Fig. 6 PRIOR ART
FIG. 6 is a back side view of the yarn feeding device shown in FIG. 5.
Figure 7:
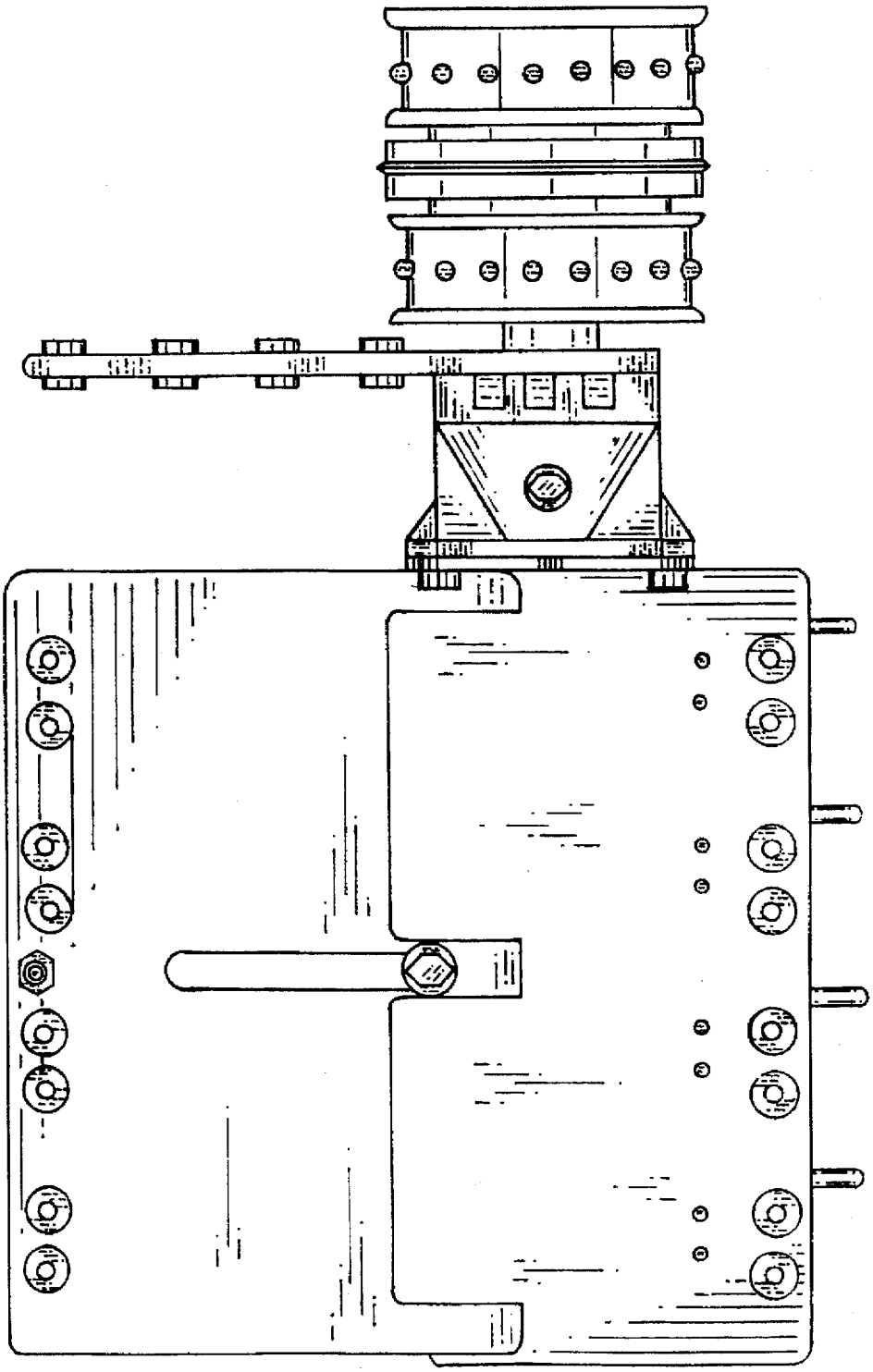
Fig. 7 PRIOR ART
FIG. 7 shows the yarn feeding device of FIG. 5 adjusted.

Referring to FIGS. from 8 to 14, the yarn feeding device in accordance with the present invention is generally comprised of a mounting frame 1, a yarn guide plate 12, a driving wheel 7, a yarn guide bracket 14, a plurality of yarn tension guides 5, and a yarn feeding wheel set 2. The mounting frame 1 is fixedly secured to the frame structure of a circular knitting machine. The yarn guide plate 12 is fixedly secured to the mounting frame 1 at the top, having a plurality of thread eyes 121 for the passing of yarns. The driving wheel 7 is mounted on the mounting frame 1 above the yarn guide plate 12, and driven to turn the yarn feeding wheel set 2. The yarn guide bracket 14 is fixedly mounted on the mounting frame 1 below the yarn guide plate 12, having two longitudinal rows of thread eyes 141, 142 for the passing of yarns. The yarn tension guides 5 are respectively mounted in the yarn guide bracket 14 by screws 59, each comprised of a casing 52, a spring element 56, a cover 53, a yarn tension guide rod 51. The yarn tension guide rod 51 of each of the yarn tension guides 5 has an upper thread eye 512 and a lower thread eye 513 at one end, and a curved rod section 514 at an opposite end set inside the respective casing 52. The yarn feeding wheel set 2 includes a plurality of plastic yarn feeding wheels 21, and a plurality of rubber collars 23 respectively mounted around the plastic yarn feeding wheels 21.

Figure 8:
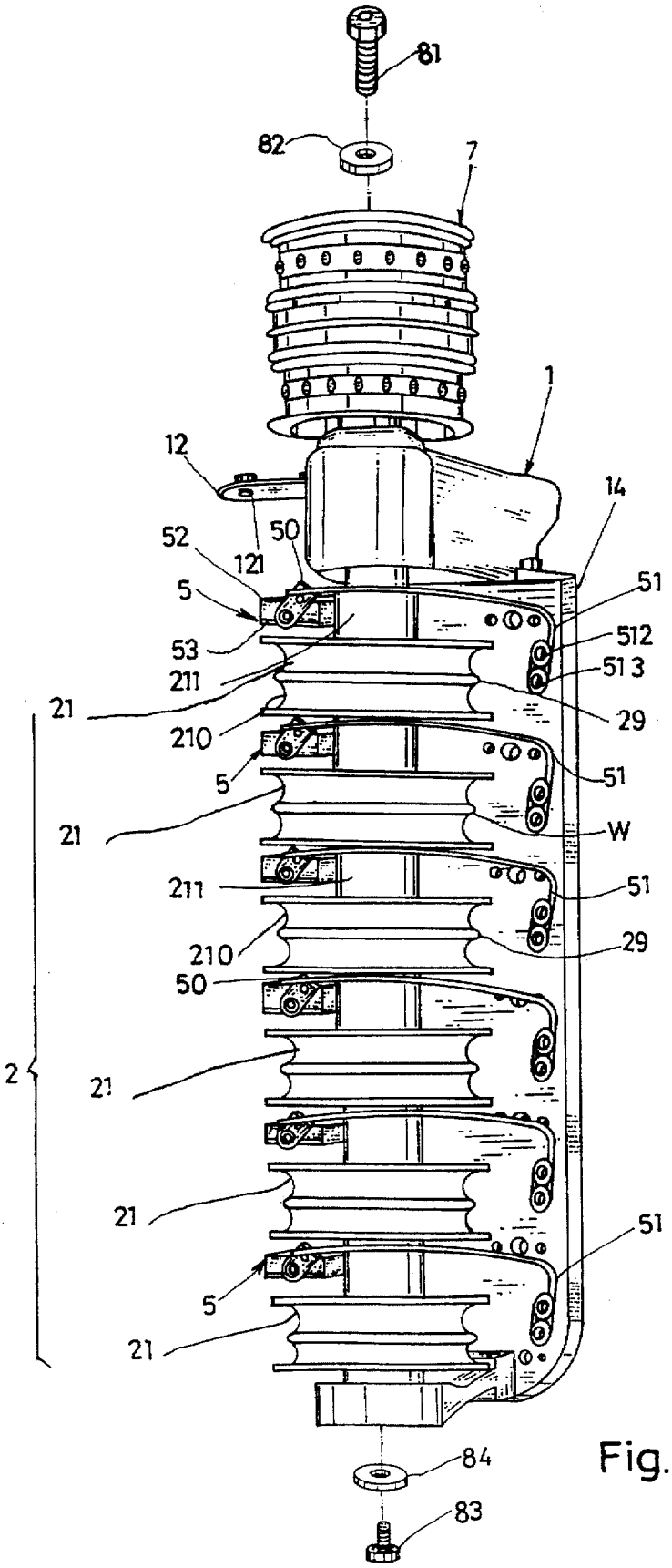
FIG. 8 is an elevational view of a yarn feeding device according to the present invention.
Figure 10:
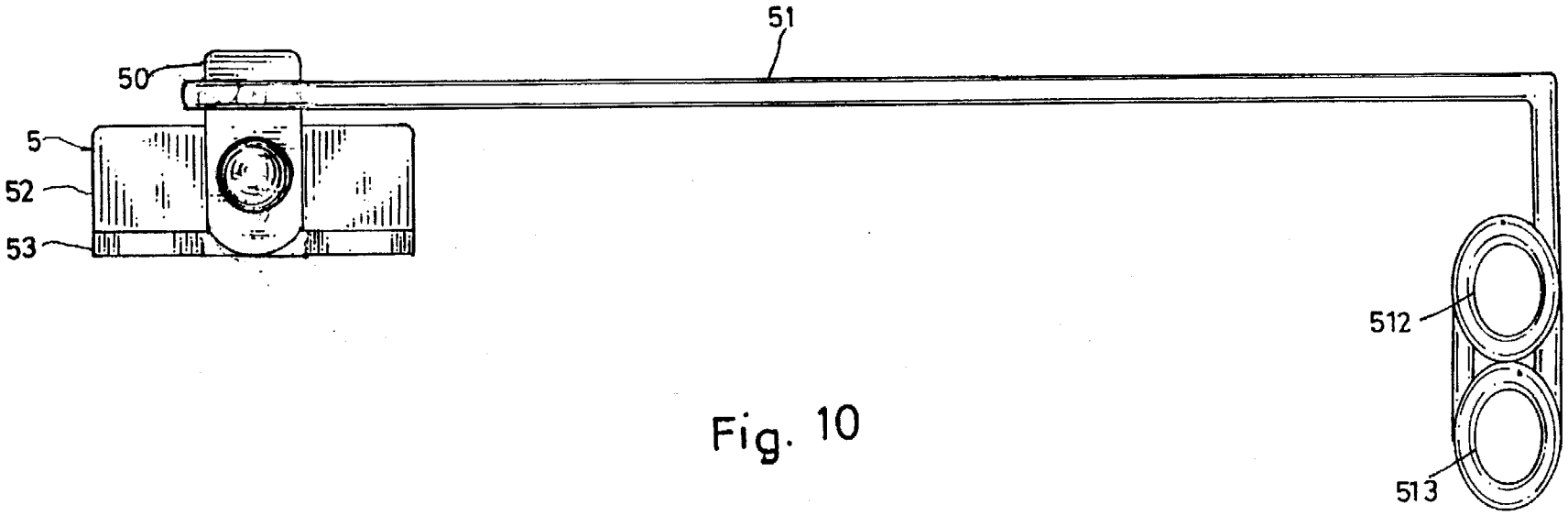
FIG. 10 is a front view in an enlarge scale of a yarn tension guide according to the present invention.
Figure 11:
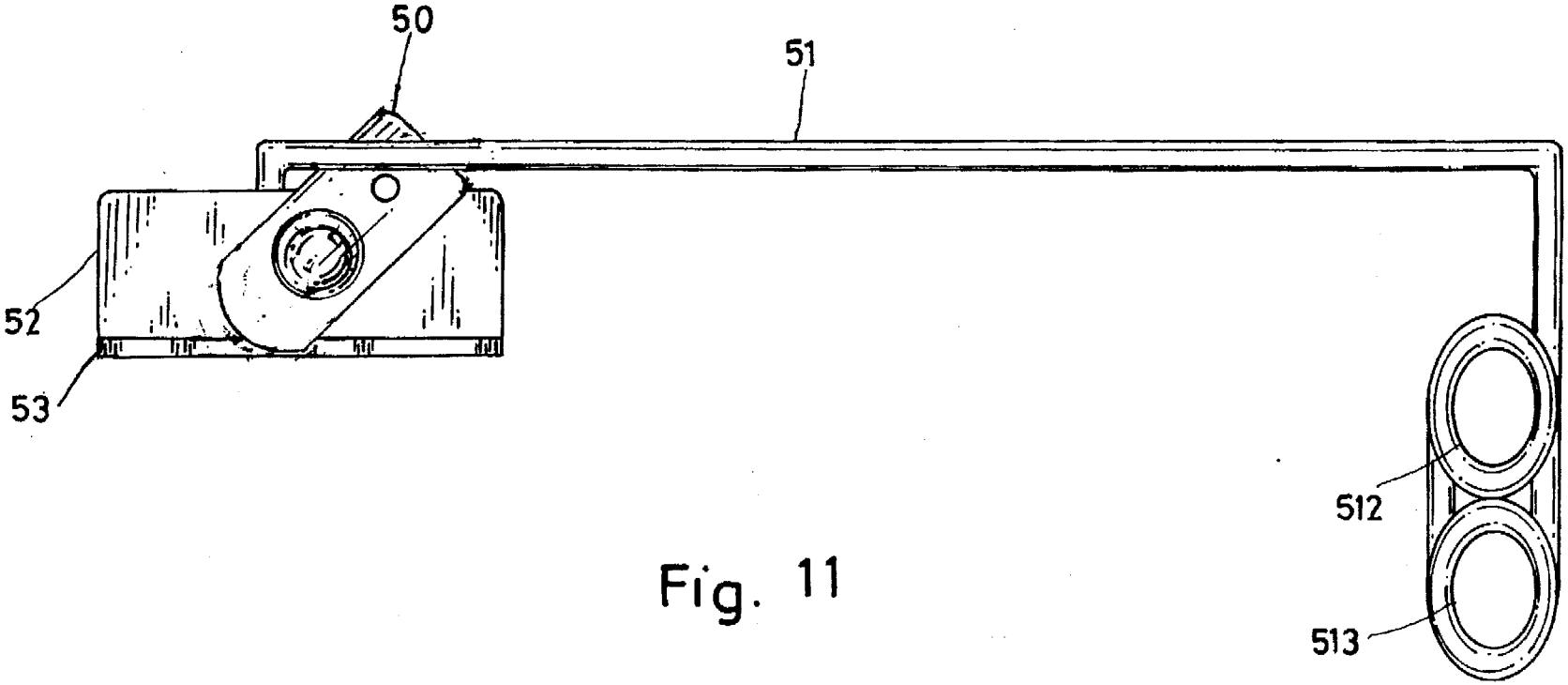
FIG. 11 is similar to FIG. 10 but showing the rotating tension adjustment plate adjusted.

Referring to FIGS. 8, 10 and 11, each of the yarn tension guides 5 has a rotating tension adjustment plate 50 pivoted to the casing 52 and abutting a respective yarn tension guide rod 51. By turning the yarn tension adjustment plate 50 relative to the respective yarn tension guide rod 51, the oscillating amplitude of the respective yarn tension guide rod 51 is relatively adjusted, and therefore the degree of circumferential engagement of the yarn with the wheel surface 210 of the corresponding yarn feeding wheel 21 is relatively adjusted.

Figure 13:
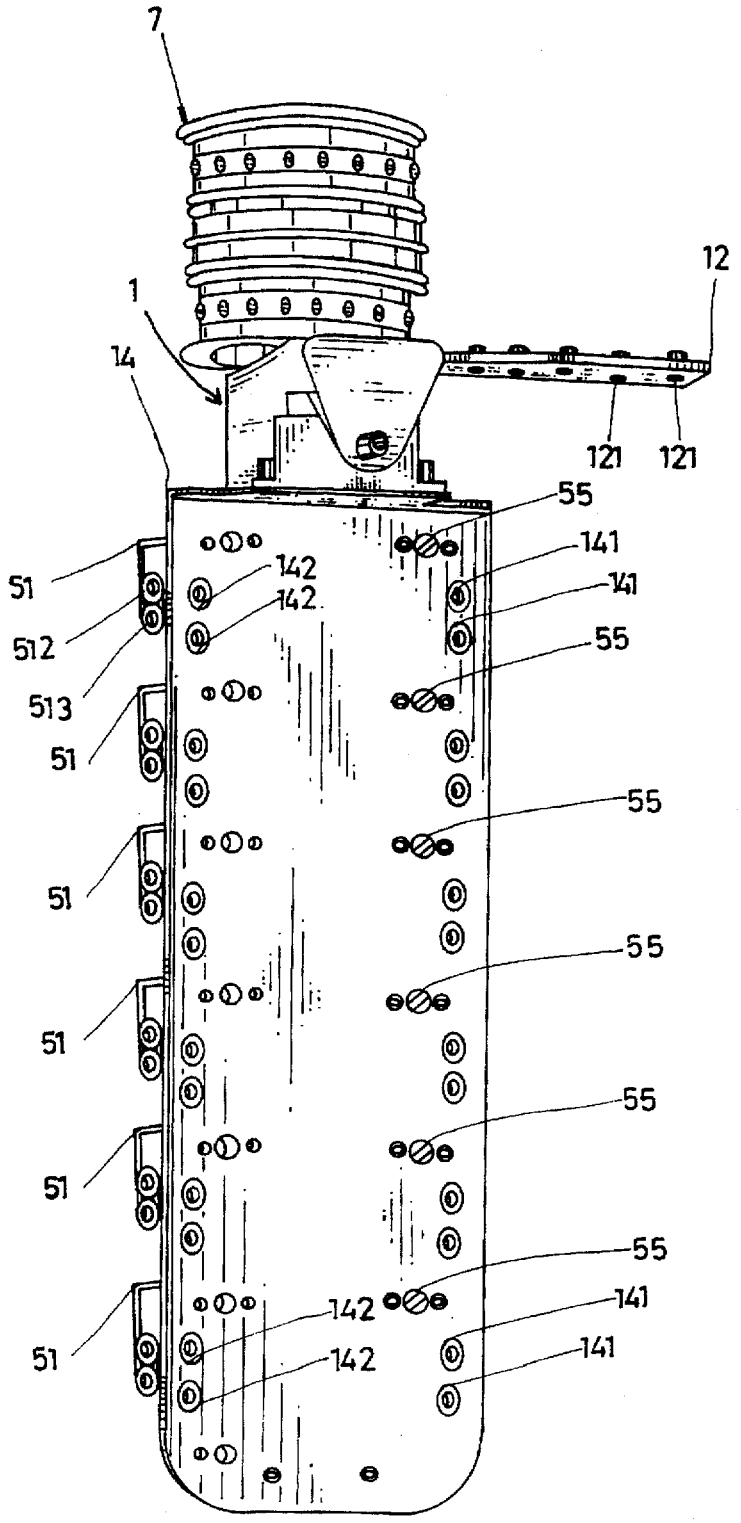
FIG. 13 is a back side view of the yarn feeding device shown in FIG. 8.
Figure 14:
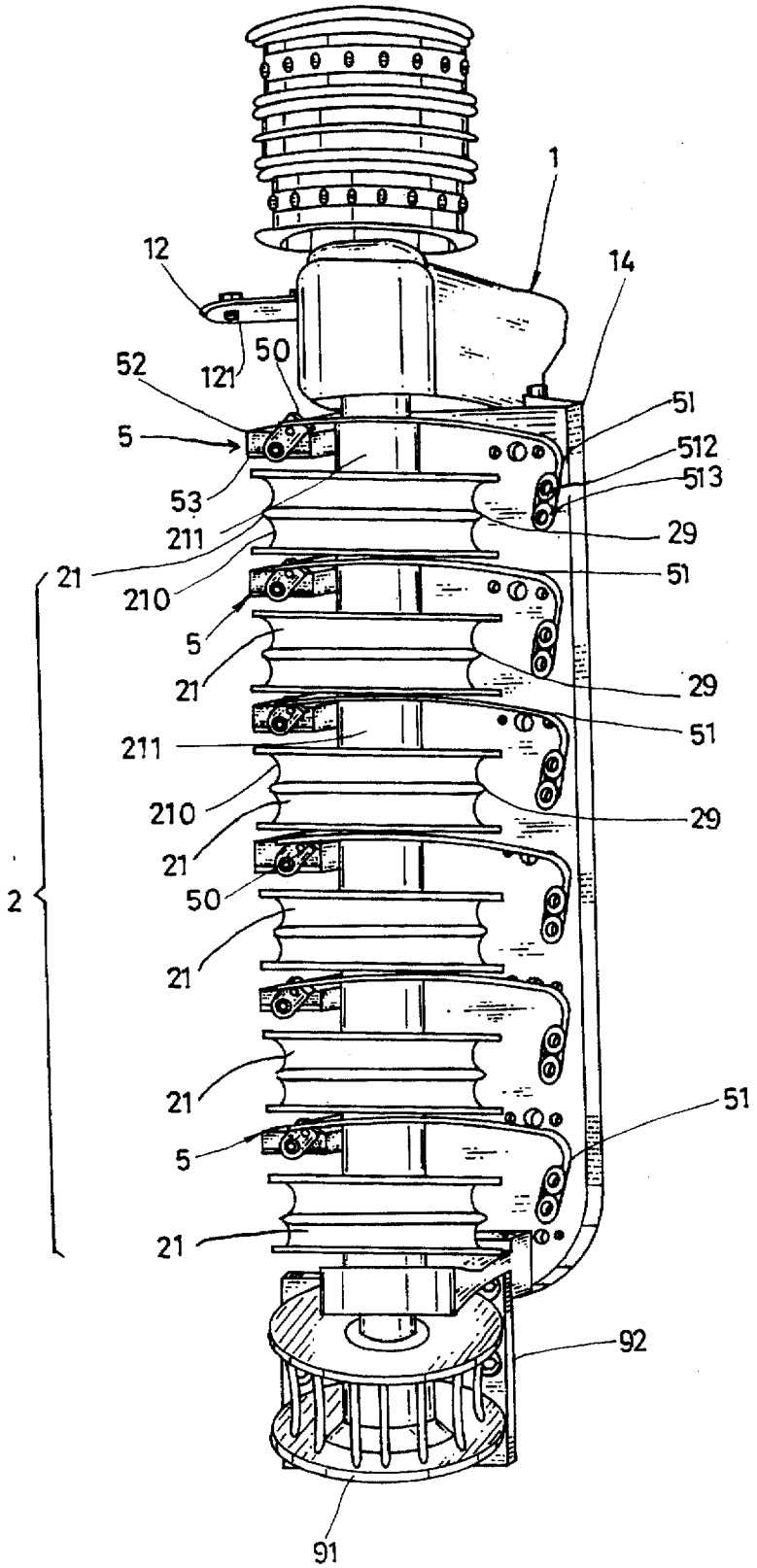
FIG. 14 is a perspective view showing the present invention with positive/storage feeding unit and yarn feeding plate.

Referring to FIG. 13, the yarn tension guides 5 are respectively disposed at an inner side adjacent to the left row of thread eyes 142 of the yarn guide bracket 14 so that sufficient space is provided for threading the yarns.

Figure 12:
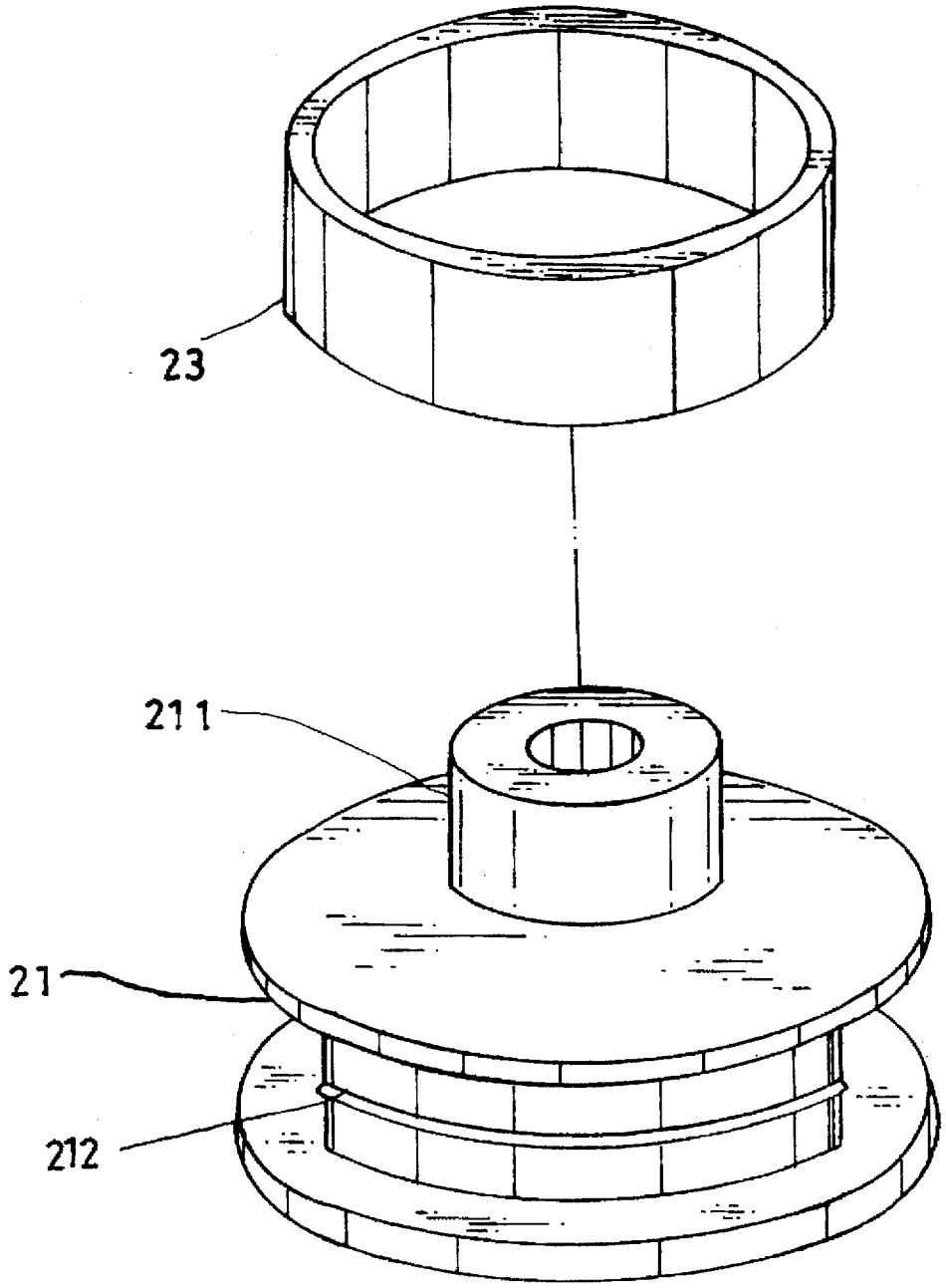
FIG. 12 is an enlarged view of one plastic yarn feeding wheel according to the present invention.

Referring to FIGS. 8 and 12, each yarn feeding wheel 21 has an annular flange 212 around the wheel face. When the rubber collar 23 is mounted around the wheel face of the respective yarn feeding wheel 21, an annular convex portion 29 is formed around the periphery of the rubber collar 23 to separate two runs of the yarn. Each of the plastic yarn feeding wheels 21 has a metal wheel hub 211. The plastic yarn feeding wheels 21 are respectively injection-molded from plastics. The metal wheel hub 211 is fastened to the respective yarn feeding wheel 21 during its injection molding process. When the plastic yarn feeding wheels 21 are respectively mounted on the wheel shaft (not shown) of the driving wheel 7 and secured thereto by screws 81, 83 and washers 82, 84, the metal wheel hubs 211 of the plastic yarn feeding wheels 21 are longitudinally connected together. Therefore, the plastic yarn feeding wheels 21 do not deform.

Figure 9:
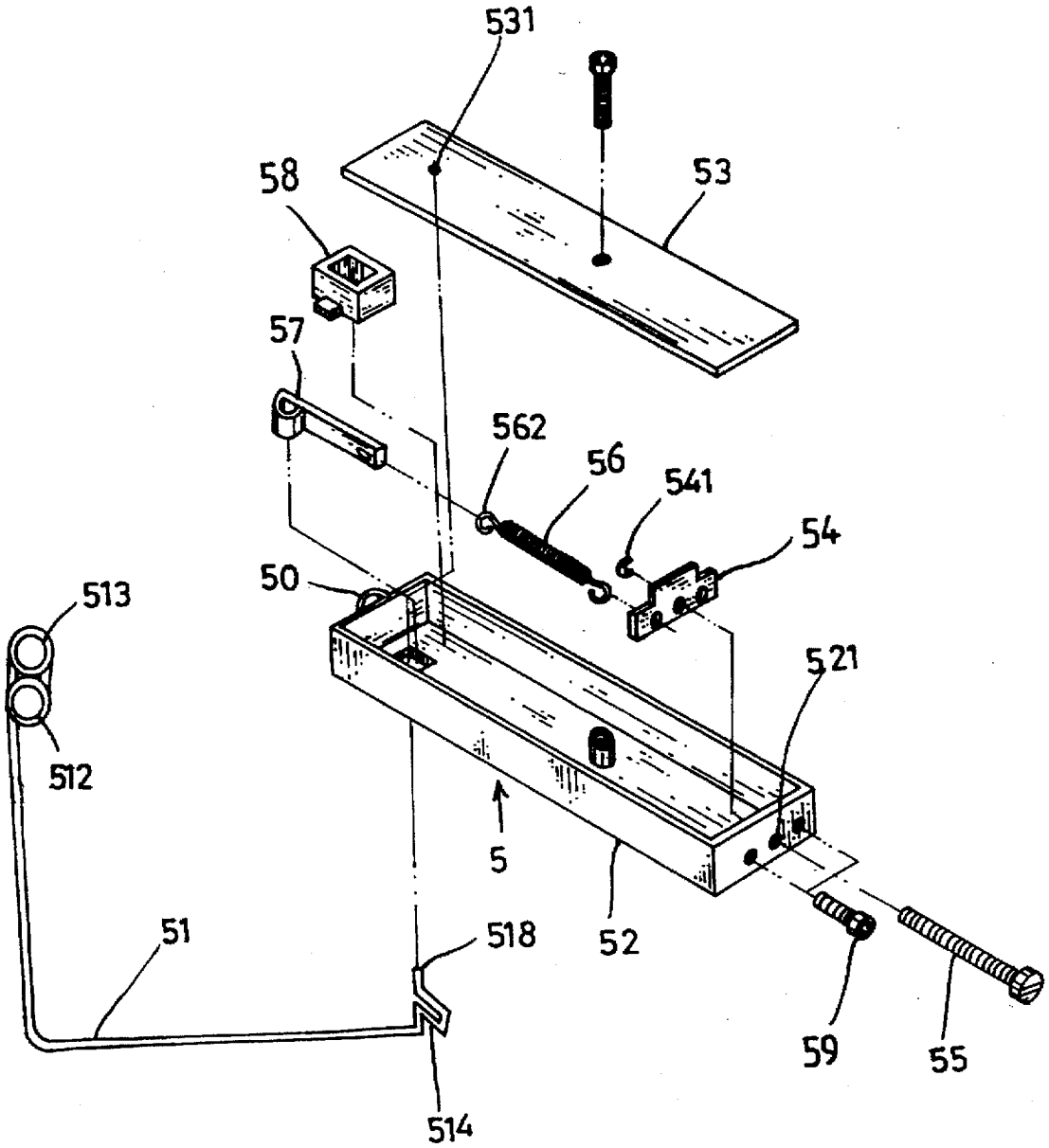
FIG. 9 is an exploded view in an enlarged scale of one yarn tension guide according to the present invention.

Referring to FIG. 9, each of the yarn tension guides 5 further comprises an adjustment screw 55 and a spring holder 54. The end 518 of the yarn tension guide rod 51 is inserted through an axle hole 531 on the casing 52. The curved rod section 514 of the yarn tension guide rod 51 is connected to one end of the spring element 56 by a connecting element 57. The locating block 58 abuts the connecting element 57. The opposite end 562 of the spring element 56 is connected to the spring holder 54. The spring holder 54 is mounted inside the casing 52. The adjustment screw 55 is threaded into a screw hole 521 on the casing 52, then inserted through a through hole (not shown) on the spring holder 54, and then fastened with a clamp 541. When the adjustment screw 55 is turned forwards or backwards, the spring holder 54 is moved relatively, and therefore the tension of the spring 56 is relatively adjusted. When the tension of the spring 56 is adjusted, the tension of the yarn tension guide rod 51 is relatively adjusted.

I claim:

1. A yarn feeding device for a circular knitting machine comprising a mounting frame having a top and secured to the circular knitting machine, a yarn guide plate having a plurality of thread eyes for passing yarn and secured to said top of said mounting frame, a driving wheel having a wheel shaft and mounted on said mounting frame above said yarn guide plate, a yarn guide bracket having first and second rows of thread eyes for passing of said yarn and mounted on said mounting frame below said yarn guide plate, a yarn feeding wheel set including a plurality of feeding wheels, each said feeding wheel including a metal wheel hub, a plastic yarn feeding wheel secured to said metal wheel hub and a rubber collar arranged around said plastic yarn feeding wheel; each said plastic yarn feeding wheel having a wheel face and an annular flange around said wheel face so that an annular convex portion is formed around a periphery of said rubber collar for separating two runs of said yarn after said collar is mounted around said plastic yarn feeding wheel; said plurality of feeding wheels mounted around said wheel shaft of said driving wheel by screws and washers with said metal hubs of said feeding wheels longitudinally arranged along said wheel shaft, and a plurality of yarn tension guides respectively mounted on said yarn guide bracket, said yarn tension guides being arranged adjacent said first row of thread eyes of said yarn guide bracket; each of said yarn tension guides having a rotating tension adjustment plate and a yarn tension guide rod, said rotating tension adjustment plate contacting yarn tension guide rod, so that when said rotating adjustment tension plate is turned relative to said yarn tension guide rod, said rotating tension adjustment plate interacts with said yarn tension guide rod thereby changing an oscillating amplitude of said yarn tension guide rod and a degree of circumferential engagement of a respective yarn with said wheel face of a respective said yarn feeding wheel.

2. The yarn feeding device of claim 1, wherein each said yarn tension guide includes a casing with an axle hole, a spring element with first and second ends, a cover, a yarn tension guide rod, an adjustment screw, a connecting element and a spring holder; said yarn tension guide rod having first and second ends, said first end of said yarn tension guide rod having an upper thread eye and a lower thread eye suspended outside said casing, said second end of said yarn tension guide rod received in said axle hole of said casing and having a curved rod section connected through said connecting element to said first end of said spring element, said second end of said spring element connected to said spring holder, said adjustment screw threaded into a screw hole on said casing and fastened to said spring holder by a clamp and arranged so that turning of said adjustment screw adjusts tension of said spring element.

* * * * *